United States Patent [19]

Walter et al.

[11] Patent Number: 4,640,571

[45] Date of Patent: Feb. 3, 1987

[54] ELECTRICAL CONNECTOR BLOCKS

[75] Inventors: Gerard S. Walter, Glenshaw; John Hagan, Gibsonia, both of Pa.

[73] Assignee: Walter Electrical Manufacturing Company, Pittsburgh, Pa.

[21] Appl. No.: 691,502

[22] Filed: Jan. 14, 1985

[51] Int. Cl.[4] ..... H01R 13/11

[52] U.S. Cl. ..... 339/242; 339/244 UC; 339/272 R; 339/272 UC

[58] Field of Search ..... 339/242, 272, 198 G, 339/198 GA

[56] References Cited

U.S. PATENT DOCUMENTS

| | | | |
|---|---|---|---|
| 1,991,075 | 2/1935 | Bloomquist | 339/272 UC |
| 2,551,636 | 5/1951 | Ratigan | 339/272 UC |
| 3,018,464 | 1/1962 | Mrenna | 339/242 |
| 3,181,106 | 4/1965 | Fiedler | 339/242 |
| 3,339,174 | 8/1967 | Walter et al. | 339/272 R |

FOREIGN PATENT DOCUMENTS

| | | | |
|---|---|---|---|
| 918316 | 2/1963 | United Kingdom | 339/272 UC |

*Primary Examiner*—Gil Weidenfeld
*Assistant Examiner*—David L. Pirlot
*Attorney, Agent, or Firm*—Buell, Ziesenheim, Beck & Alstadt

[57] ABSTRACT

An electrical connector block is provided having a housing with a pair of generally parallel sidewalls extending from a base member and separated by a trough open on the side opposite the base member, a groove on each sidewall opposite the trough and spaced from the open side of the trough, a cap member having depending arms adapted to slide along the sides of the parallel sidewalls over the open trough, said arms having inturned flanges engaged in the grooves of the sidewall, at least one screw member threadingly engaged in said cap member and carry a clamp member pivoted on the end thereof between the sidewalls for clamping a wire between the clamp member and base member.

8 Claims, 14 Drawing Figures

Fig. 7.
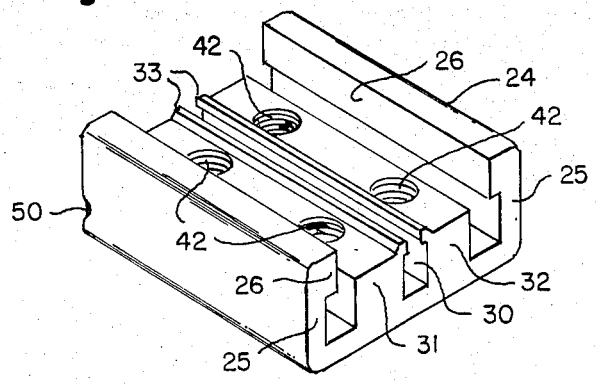
Fig. 8.
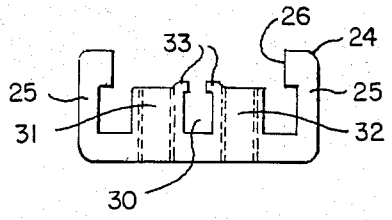
Fig. 10.
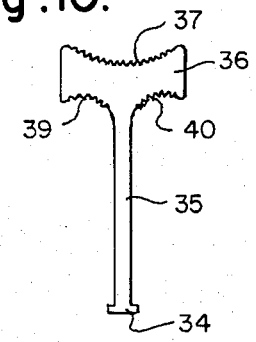
Fig. 9.
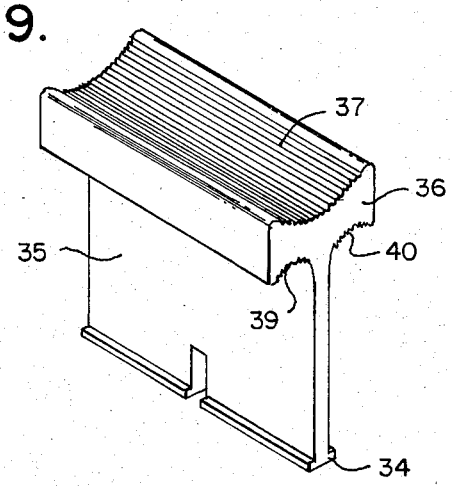
Fig. 12.
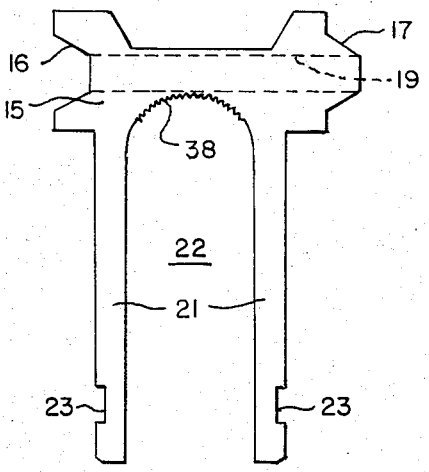
Fig. 11.
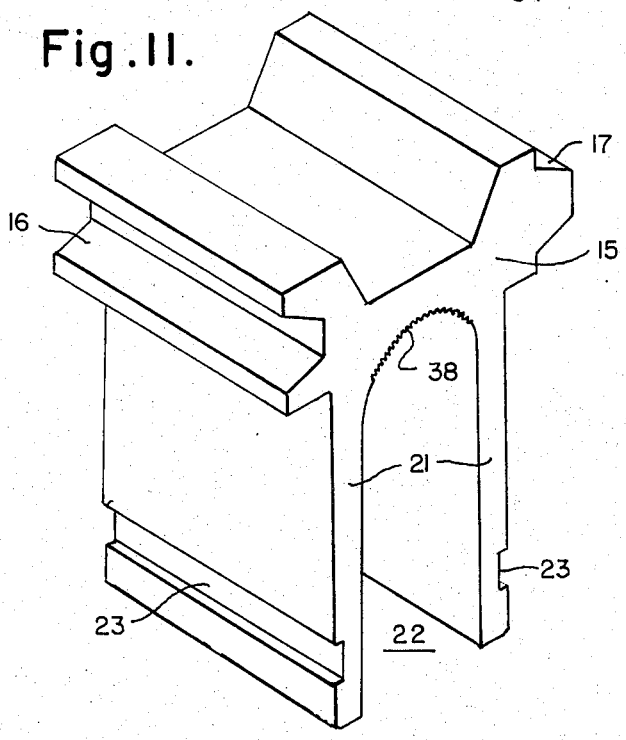
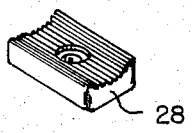
Fig. 13.
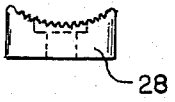
Fig. 14.

ELECTRICAL CONNECTOR BLOCKS

The present invention relates to electrical connector blocks and particularly to a modular form of connector block which may be used to couple various sizes of cables together in various multiples and in which the modules may take different sizes and be connected together to form a single integral unit.

In the past it has been the practice to connect heavy conductors together or to a busbar using wire clamps with a screw type clamp to apply connecting pressure to the conductor. Typical of such prior art connectors are those illustrated in U.S. Pat. Nos. 1,913,552; 2,232,602; 2,288,941; 2,290,691; 2,569,223; 3,047,835; 3,335,399, earlier Walter U.S. Pat. Nos. 3,425,022 and 3,551,876 and in French Pat. No. 888,909; British Pat. No. 692,707 and German Pat. No. 736,704. These earlier patents, while excellent for their time and purpose were limited in number and variety of wire connections that they could be used to make.

We have invented a connector structure which can connect as many as these connections in a single module and the number of modules which may be connected together to form a single connector is limited only by the length of available threaded fasteners to connect them together.

We provide an electrical connector comprising a housing having a pair of generally parallel elongate sidewalls extending from a base member and separated by a trough open on the side opposite the base member, a groove on each side wall opposite the trough and equally spaced from the open side of the trough, a cap member having depending arms adapted to slide along the sides of the parallel sidewalls over the open trough and having internal flanges engaged in the grooves in the sidewall, at least one screw member threadingly engaged in said cap member and carrying a clamp member pivoted therein for clamping a wire between said clamp member and the base member. Preferably the base member has a cylindrical surface at the bottom of the trough and the clamp member has a like surface whereby a generally cylindrical wire can be clamped therebetween. Preferably interchangeable cap members are provided having either one or three clamping members. The cap member having three clamp members is preferably provided with a pair of depending members between its depending arms on opposite sides of the sidewalls from said arms forming a central channel between them, each central member has an inturned flange toward the other forming a supporting trackway carrying an enlarged end on the stem of a generally T-shaped member movable in the channel toward and away from the base and a pair of screw members in the cap member on opposite sides of the T member, each carrying a clamp member pivoted thereon adapted to clamp a wire between it and a clamp surface on the head of the T and to exert pressure thereon to move the head of the T to clamp a layer wire between it and the base so as to form a three wire clamp. Preferably the base is provided below the sidewalls with a groove on one side and an interfitting projection on the other so that side by side clamp members can be interfittingly connected in conductive relation. The base preferably has spaced passages therethrough receiving fasteners such as bolts through said interfitting grooves and projections to tightly fastened adjoining clamps.

In the foregoing general description of our invention, we have set out certain objects, purposes and advantages to be achieved thereby. Other objects, purposes and advantages of the invention will be apparent from a consideration of the following description and the accompanying drawings in which:

FIG. 7 is an isometric view of the under side of a cap member for a three wire connector;

FIG. 8 is an end view of the cap member of FIG. 7;

FIG. 9 is an isometric view of a T-clamp member for use with the cap member of FIG. 7 in forming a three wire clamp;

FIG. 10 is an end view of the T-clamp member of FIG. 9;

FIG. 11 is an isometric view from the base of a clamp base and sidewalls according to the invention;

FIG. 12 is an end elevation of the clamp base and sidewall structure of FIG. 11;

FIG. 13 is an isometric view of a clamp member for pivotal attachment on a screw according to this invention; and FIG. 14 is an end elevation of the clamp member of FIG. 13.

Figure 2:
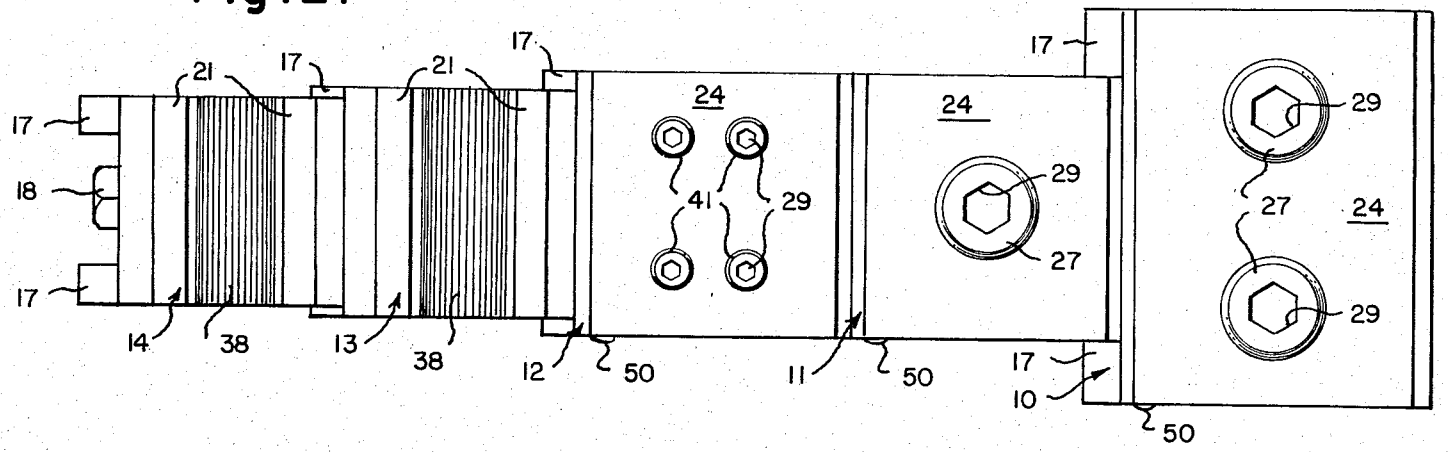
FIG. 2 is a top plan view of the assembly of FIG. 1.
Figure 1:
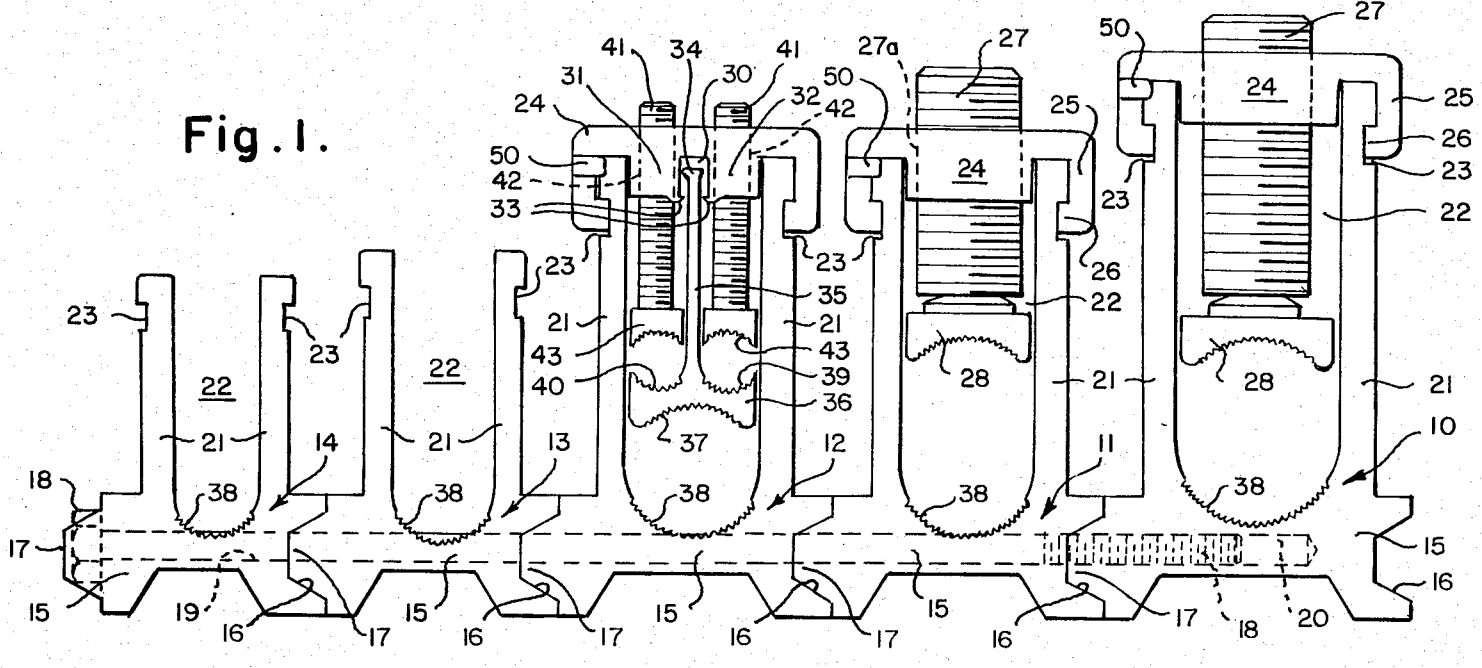
FIG. 1 is an end elevational view of a plurality of conductor clamps of this invention and of different sizes and configurations connected together to form a unitary conductive clamp assembly.
Figure 3:
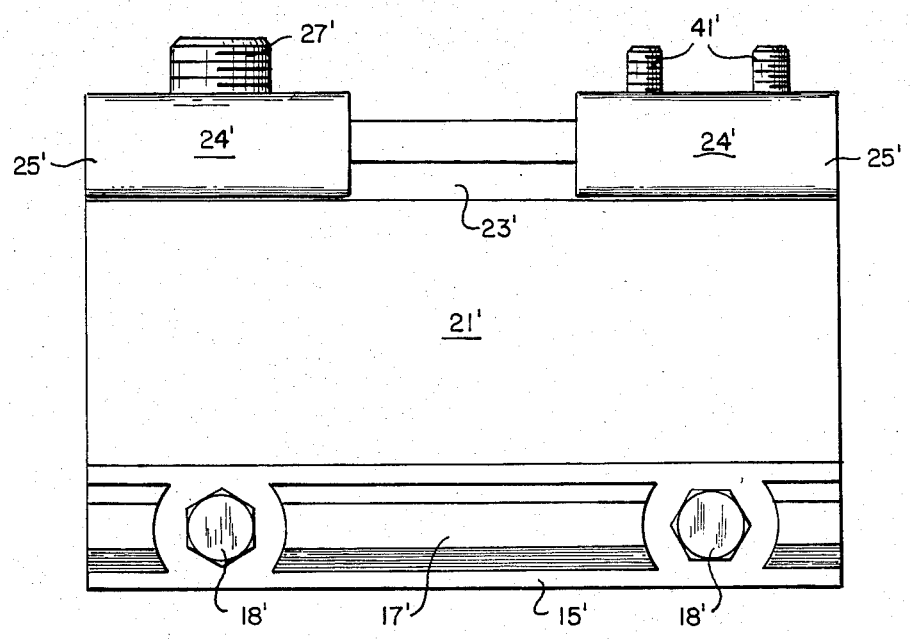
FIG. 3 is a side elevational view of a wire clamp according to the invention with a single wire clamp at one end and a triple wire clamp at the other end.
Figure 4:
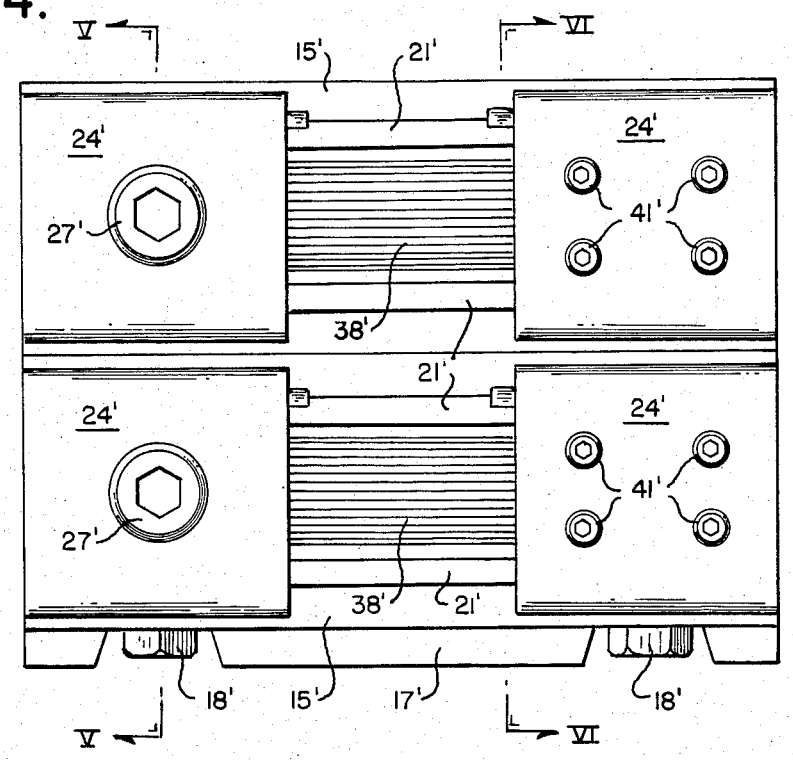
FIG. 4 is a top plan view of the connector assembly of FIG. 5.
Figure 5:
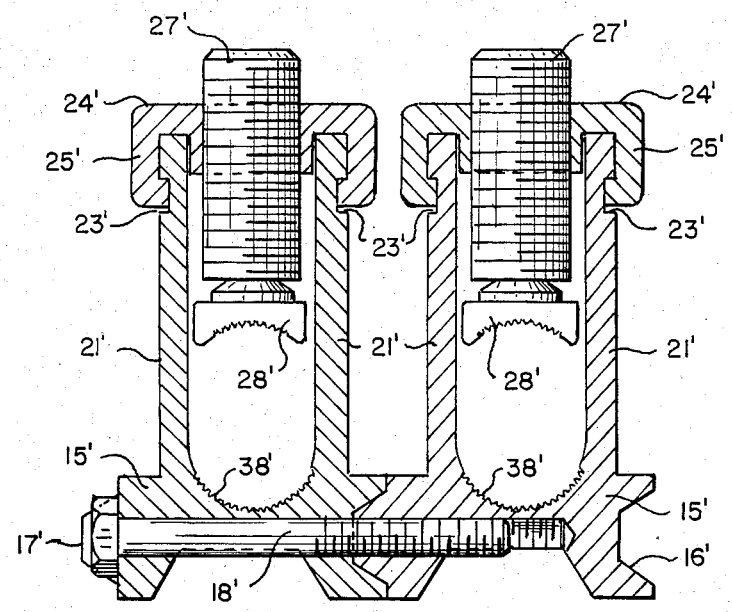
FIG. 5 is a sectional view on the line V—V of FIG. 4 showing the end adapted for a single wire connection.
Figure 6:
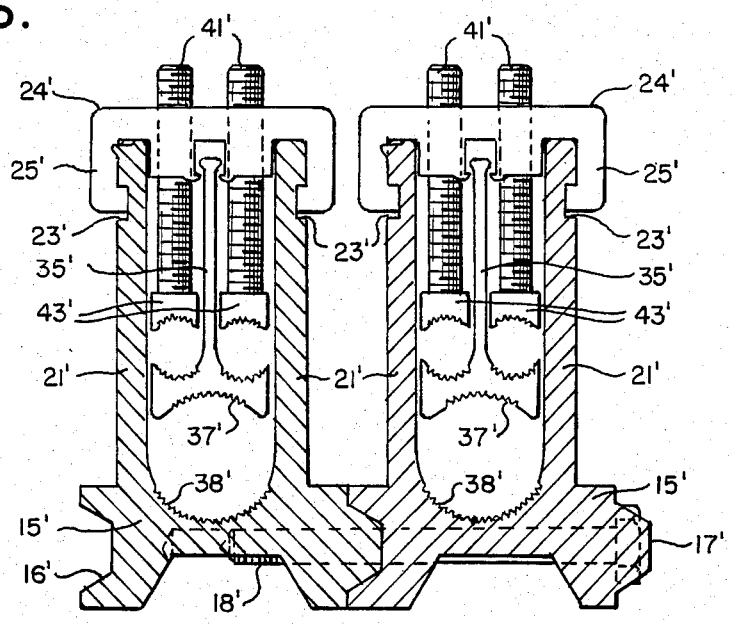
FIG. 6 is a sectional view on the line VI—VI of FIG. 4 showing the end adapted for three wire connection.

Referring to the drawings, we have illustrated in FIGS. 1 and 2, a plurality of wire clamps 10, 11, 12, 13 and 14 of different sizes according to this invention. Each clamp has a base 15 of indentical thickness having identical grooves 16 on one side and identical projections 17 on the other side interfitting in grooves 16. The wire clamps are held together in tight interfitting conductive relationship by a bolt 18 passing through holes 19 in each clamp and threadingly engaging threads 20 in the last clamp of the assembly or in a nut (not shown) on the outside of the last clamp of the assembly.

Each clamp is provided with generally parallel vertical sidewalls 21 extending above base 15 to form a trough 22 therebetween. Each sidewall has a groove 23 adjacent the end remote from base 15 extending the length of the sidewall. A cap member 24 having depending arms 25 slidable along the top and outside of the sidewalls over grooves 23 is fitted on each clamp. Each depending arm 25 has an inturned flange 26 engaging in groove 23 to hold the cap member on the sidewalls. In a single clamp arrangement as used with clamp 11, a screw member 27 is threaded in a hole **27*a* in the cap member 24. The screw member 27 is provided with a clamp member 28 pivoted on the end thereof within trough 22 and a drive connection such as a hexagonal hole 29 or the like at the other end, outside the clamp. As illustrated in connection with clamp 10 the clamp may have two screws 27 and clamp member 28 at opposite ends. Further as illustrated in clamp 12, the cap member 24 may have a central channel 30 formed between two depending members 31 and 32** each having an inturned flange 33 forming a supporting trackway for an enlarged end 34 on the stem 35 of T-shaped member having a head 36 spaced from base 15. Head 36 has a curved surface 37 facing the curved surface 38 of the base 15 and on generally the same radius. On the opposite side, head 36 has two curved surfaces 39 and 40. Screw members 41 are threaded in holes 42 in cap member 24 on opposite sides of channel 30. Each screw member is fitted at one end with a pivoted clamp member 43, slidable between stem 35 and sidewalls 21. The other end has a drive connection such as hexagonal hole 29. Here again, the cap member may have a pair of clamps screws at each end as shown or only at one end (not shown). Preferably at least one of the sidewalls is provided with a stop detent 50 along one top edge to limit movement of cap member 24.

In FIGS. 3 through 6 we have illustrated an embodiment in which one end of the clamp is arranged for two wire connection and the other end for three wire connection. The elements are identical to elements of FIGS. 1 and 2 and bear like identifying numerals with a prime sign.

As can be seen from FIGS. 1 through 6, the clamp of this invention may take various sizes and assembly configurations for connecting different size wires.

In the foregoing specification we have set out certain preferred practices and embodiments of our invention however, it will be understood that this invention may be otherwise embodied within the scope of the following claims.

We claim:

1. An electrical connector block comprising a housing having a pair of generally parallel elongate sidewalls extending from a base member and separated by a trough open on the side opposite the base member, said trough extending from a first end of said base member to a second end thereof, a groove on each sidewall opposite the trough and spaced from the open side of the trough, a cap member having depending arms along each side edge adapted to slide along the outer sides of the parallel sidewalls over the open trough, said arms having inturned flanges engaged in the grooves of the sidewall, at least one depending member on said cap member extending between the sidewalls of the base member, at least one screw member threadingly engaged in said cap member through said at least one depending member and carrying a clamp member pivoted on the end thereof between the sidewalls for clamping a wire between the clamp member and base member, said base member having a V-groove extending generally parallel to the trough bottom along one side of said base member from said first end to said second end and a like shaped fully interfitting V-tongue parallel thereto on the other side of said base member and passages through the base transverse to the tongue and groove and passing therethrough receiving a fastener means whereby a plurality of connectors may be conductively and integrally connected together.

2. An electrical connector block as claimed in claim 1 wherein the base member has a cylindrical surface at the bottom of the trough and the clamp member has a like cylindrical surface facing the bottom of the trough whereby a generally cylindrical wire can be clamped therebetween.

3. An electrical connector as claimed in claim 1 or 2 wherein the cap member has a single screw member and the clamp member extends between the sidewalls.

4. An electrical connector as claimed in claims 1 or 2 wherein at least one sidewall has a detent for limiting the movement of the cap member.

5. An electrical connector block comprising a housing having a pair of generally parallel elongate sidewalls extending from a base member and separated by a trough open on the side opposite the base member, a groove on each sidewall opposite the trough and spaced from the open side of the trough, a cap member having depending arms adapted to slide along the sides of the parallel sidewalls over the open trough, said arms having inturned flanges engaged in the grooves of the sidewalls, at least one screw member threadingly engaged in said cap member and carrying a clamp member pivoted on the end thereof between the sidewalls for clamping a wire between the clamp member and base member and wherein the cap member is provided with a pair of depending members between the sidewalls forming a channel intermediate the sidewalls, an inturned flange on each depending member extending partially across the channel to form a trackway, an inverted T-shaped member having an enlarged end on the stem thereof adapted to be supported on said trackway and move vertically in the channel so that the head of the T can move toward and away from the base member, a pair of screw members in the cap member in said depending members, a pivotal clamp member on the end of each screw member between a sidewall and the stem of the T member, a clamping surface of the T head facing the base and a clamp surface on the opposite side of the T head between the stem and sidewall whereby a large wire may be clamped between the T head and base member and two smaller wires between the clamp members on the screw members and the clamp surfaces on the opposite side of the T head.

6. An electrical connector as claimed in claim 5 wherein the base is provided with a V-groove on one side below a sidewall and generally parallel to the trough and with a like shaped interfitting V-tongue on the other side and with passages through the base receiving a fastener means whereby a plurality of connectors may be conductively and integrally connected together.

7. An electrical connector as claimed in claim 5 wherein the base is provided with a groove on one side below a sidewall and with a like shaped interfitting projection on the other side and with passages through the base receiving a fastener means whereby a plurality of connectors may be conductively and integrally connected together.

8. An electrical connector as claimed in claim 5 or 6 or 7 wherein at least one sidewall has a detent for limiting the movement of the cap member.

* * * * *